US010190479B2

(12) United States Patent
Reichenbach et al.

(10) Patent No.: US 10,190,479 B2
(45) Date of Patent: Jan. 29, 2019

(54) COOLING SYSTEM WITH A COOLANT PUMP FOR AN INTERNAL COMBUSTION ENGINE

(71) Applicant: GM GLOBAL TECHNOLOGY OPERATIONS LLC, Detroit, MI (US)

(72) Inventors: Mario Reichenbach, Ruesselsheim (DE); Torsten Mueller, Rüsselheim (DE); Michael Brinker, Ruesselsheim (DE); Michael Selinger, Mainz (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 129 days.

(21) Appl. No.: 15/155,524

(22) Filed: May 16, 2016

(65) Prior Publication Data

US 2016/0333769 A1 Nov. 17, 2016

(30) Foreign Application Priority Data

May 16, 2015 (DE) ..... 10 2015 006 302

(51) Int. Cl.
*F01P 7/16* (2006.01)
*F01P 3/20* (2006.01)

(52) U.S. Cl.
CPC ..... *F01P 7/167* (2013.01); *F01P 3/20* (2013.01); *F01P 2060/04* (2013.01); *F01P 2060/08* (2013.01)

(58) Field of Classification Search
CPC ..... F01P 7/167; F01P 3/20; F01P 2060/04; F01P 2060/08
USPC ..... 123/41.44, 41.05, 41.12
See application file for complete search history.

(56) References Cited

U.S. PATENT DOCUMENTS

| | | | | |
|---|---|---|---|---|
| 5,056,601 | A * | 10/1991 | Grimmer | F01P 3/20 123/41.33 |
| 5,121,714 | A * | 6/1992 | Susa | F01P 7/165 123/41.1 |
| 5,724,924 | A | 3/1998 | Michels | |
| 6,394,045 | B1 | 5/2002 | Perset | |
| 6,425,353 | B1 | 7/2002 | Davies | |
| 8,590,495 | B2 * | 11/2013 | Kobayashi | F01P 7/081 123/179.4 |
| 8,813,692 | B2 * | 8/2014 | Bialas | F01P 7/167 123/41.01 |
| 9,850,802 | B2 * | 12/2017 | Amano | B60H 1/00314 |
| 2006/0157000 | A1 * | 7/2006 | Lutze | F01P 3/20 123/41.02 |
| 2013/0142669 | A1 | 6/2013 | Pyle et al. | |

FOREIGN PATENT DOCUMENTS

| | | | |
|---|---|---|---|
| EP | 1375213 | A2 | 1/2004 |
| WO | 03106825 | A1 | 12/2003 |
| WO | 2013003950 | A1 | 1/2013 |

OTHER PUBLICATIONS

Great Britain Patent Office, Great Britain Search Report for Great Britain Application No. GB1602277.4, dated Jul. 7, 2016.
German Patent Office, German Search Report for German Application No. 102015006302.2, dated Jan. 13, 2016.

* cited by examiner

*Primary Examiner* — Syed O Hasan
(74) *Attorney, Agent, or Firm* — Lorenz & Kopf, LLP

(57) ABSTRACT

A method is disclosed for operating a cooling system with a heater and a coolant pump for an internal combustion engine. The cooling system is switched into a predetermined operating mode as a function of a heater request and a temperature.

14 Claims, 2 Drawing Sheets

COOLING SYSTEM WITH A COOLANT PUMP FOR AN INTERNAL COMBUSTION ENGINE

CROSS-REFERENCE TO RELATED APPLICATION

This application claims priority to German Patent Application No. 102015006302.2, filed May 16, 2015, which is incorporated herein by reference in its entirety.

TECHNICAL FIELD

The present disclosure pertains to a cooling system with a coolant pump and a heater for an internal combustion engine, to a method for operating the cooling system, to a motor vehicle with the cooling system and to a computer program product for carrying out the method.

BACKGROUND

WO 03/106825 A1 discloses a method for operating a liquid-cooled internal combustion engine, in which an electric coolant pump is briefly operated for a period of time following detection of a cold start and after expiration of the period of time is always deactivated again. For as long as a coolant temperature is below a threshold value, the coolant pump is then activated with alternating direction of delivery. As soon as the coolant temperature has reached the threshold value, the coolant pump is activated in such a manner that a continuous coolant flow is obtained, and a control valve is actuated as a function of the coolant temperature in order to flow through a bypass with an oil-coolant heat exchanger and at higher coolant temperatures and a radiator.

SUMMARY

The present disclosure improves the operation of a cooling system for an internal combustion engine, in particular of a motor vehicle. According to an aspect of the present disclosure, a cooling system for an internal combustion engine, in particular a cooling system of a motor vehicle such as a passenger car, includes a coolant pump for delivering or circulating a liquid coolant, such as cooling water through one or more coolant lines and a heater or interior-coolant heat exchanger. The internal combustion engine in an embodiment is a spark-ignition or diesel engine and/or includes an exhaust gas turbocharger. The coolant pump in an embodiment is an electric or electrically pump in particular electric motor actuated coolant pump. Because of this, it can be advantageously operated independently of the combustion engine.

In an embodiment, the cooling system includes an electrically actuated control valve, such as a rotary control valve, by way of which in an embodiment, optionally or dependent on position, a radiator line, in which a radiator or interior-coolant heat exchanger is arranged, and/or a bypass line that is in particular parallel in terms of flow to the radiator line, in which in an embodiment an oil-coolant heat exchanger is arranged, can be opened and closed beforehand, in particular variably opened and closed. In an embodiment, the cooling system includes a heater line that is independent of the control valve and/or parallel in terms of flow with the radiator and/or bypass line, in which the heater is arranged. In an embodiment, the cooling system includes a coolant temperature sensor for detecting a coolant temperature which can be arranged upstream in front of the control valve, downstream after the control valve or in the control valve.

Additionally or alternatively, the cooling system in an embodiment includes a reference temperature sensor for detecting a reference temperature, such as a material and/or component temperature. The reference temperature in an embodiment can be a critical or maximum temperature of a component of the internal combustion engine or of another component of the motor vehicle or depend on the same, for example a cylinder head or turbocharger temperature.

Additionally or alternatively, the reference temperature in an embodiment can also be calculated in a model based determination, for example based on kinematic or kinetic parameters of the internal combustion engine or of the motor vehicle such as for example a torque, a rotational speed and/or a driving speed.

By way of a reference temperature sensor the reference temperature in an embodiment can be advantageously detected precisely and/or reliably. By way of a model-supported determination, the reference temperature in an embodiment can be advantageously determined simply, in particular without a sensor directly measuring the same.

A method for operating a cooling system with a coolant pump and a heater for the internal combustion engine is provided according to an aspect of the present disclosure. The cooling system is switched into a predetermined operating mode as a function of a heater request and a temperature. The cooling system is equipped in terms of hardware and/or software, for carrying out a method herein described and includes a switch, controller or other means for switching the cooling system into a predetermined operating mode as a function of a heater request and a temperature.

By switching into a predetermined operating mode as a function of a detection, a heater request or a request of a heating output, such as a minimum heating output, or an operation, such as a minimum operation, of the heater performance or heat for heating an interior of the motor vehicle can, in an embodiment, be advantageously made available. Accordingly, a heater request in this case is to mean a detected request of a heating output, such as at least of a predetermined minimum heating output, or an operation at least one predetermined minimum operation of the heater.

In an embodiment, switching from a first warming-up operating mode described in the following, in which the coolant pump is not operated, is performed as a function of a heater request and the reference temperature into a second warming-up operating mode in which the coolant pump is operated pulsed or with a predetermined rotational speed, provided that or when a heater request is detected or present and the reference temperature exceeds a predetermined limit value, which for distinction from further limit values described in the following without restriction of the generality is described as fifth limit value.

This switching can take place in particular independently or additionally to a switching as a consequence of the fulfilled second warming-up condition described in the following. Because of this, switching into the second warming-up operating mode can be advantageously carried out in an embodiment and thus already heated coolant actively supplied to the heater when a heater request is detected.

Accordingly, the cooling system in an embodiment includes a switch, controller or other means for switching the cooling system as a function of a heater request and the reference temperature from a first warming-up operating mode, in which the coolant pump is not operated, into a second warming-up operating mode, in which the coolant pump is operated pulsed or with a predetermined rotational speed.

Additionally or alternatively, switching into a heater operating mode, in which the coolant pump is operated with a rotational speed that is predetermined dependent on a heater request and/or with a constant rotational speed and/or continuously as a function of a heater request and/or a or the coolant temperature, such as from the second warming-up operating mode, in which the coolant pump is operated pulsed or with a rotational speed predetermined independently of a heater request, provided that or when a heater request is detected or present and the coolant temperature exceeds a predetermined limit value which for distinction from further limit values described in the following without restriction of the generality is described as sixth limit value. In a further development, switching into the heater operating mode is carried out only after a predetermined period of time following the detecting of the heater request and the exceeding of the sixth limit value. Because of this, coolant can be initially advantageously circulated for the predetermined period of time in the warming-up operating mode, thereby improving the warming-up.

By way of a heater operating mode, in which the coolant pump is operated with a rotational speed that is predetermined dependent on a heater request and/or a constant rotational speed and/or continuously, the heater in an embodiment can be advantageously supplied with coolant.

The rotational speed of the coolant pump in the heater operating mode predetermined dependent on a heater request increases in an embodiment with a percentage heater request, in particular linearly and/or in discrete jumps. Accordingly, a first constant rotational speed of the coolant pump can become or be predetermined for example for a first percentage region of a maximum possible heater request or requested heater output, for example for 5-25%, for a higher second region, approximately 25-50% a higher second constant rotational speed of the coolant pump, for an even higher third region, approximately 50-75% an even greater third constant, rotational speed of the coolant pump and for an even higher fourth region, approximately 75-100%, an even higher fourth constant, rotational speed of the coolant pump.

Accordingly, the cooling system in an embodiment includes a switch, controller or other means for switching the cooling system as a function of a heater request and a coolant temperature into a heater operating mode, in which the coolant pump is operated with a rotational speed that is dependent on a heater request and/or constant and/or continuously, in particular from the second warming-up operating mode, in which the coolant pump is operated pulsed or with a rotational speed that is predetermined independently of a heater request.

Additionally or alternatively, switching from the first warming-up operating mode into the heater operating mode can also be performed as a function of a heater request and/or a or the coolant or reference temperature, in particular in the case that in an embodiment no second warming-up operating mode is provided.

In an embodiment, the radiator line of the cooling system, in which the radiator is arranged, and/or the bypass line of the cooling system, in which the oil-coolant heat exchanger is arranged, becomes or is closed or opened such as dependent on temperature in the heater operating mode. Accordingly, the cooling system in an embodiment includes a valve, actuator, controller or other means for closing or opening the radiator line and/or the bypass line in particular in a temperature-dependent manner in the heater operating mode.

By way of a closed radiator line, more heat can be advantageously supplied to the heater in the heater operating mode in an embodiment. By way of a closed bypass line, the heater, in an embodiment, can be advantageously supplied with even more heat in the heater operating mode. By way of an at least partly opened bypass line heat, in an embodiment, can be advantageously supplied also to the oil-coolant heat exchanger in the heater operating mode.

In an embodiment, the cooling system is switched over as a function of the coolant temperature from the heater operating mode into the first warming-up operating mode when or provided that the coolant temperature undershoots a predetermined limit value, which for distinction from further limit values described in the following is described without restriction of the generality as seventh limit value. In an embodiment, the seventh limit value is smaller by a predetermined hysteresis deduction than the sixth limit value in order to avoid too frequent switching.

Accordingly, the cooling system in an embodiment includes a switch, controller or other means for switching the cooling system from the heater operating mode into the first warming-up operating mode as a function of the coolant temperature.

In an embodiment, switching from the heater operating mode into a closed loop control operating mode the one described in the following is performed in that the coolant pump and/or a or the control valve of the cooling system is open or closed loop controlled in the case that a fifth warming-up condition is fulfilled. Accordingly, the cooling system in an embodiment includes a switch, controller or other means for switching the cooling system from the heater operating mode into the closed loop control operating mode, in which the coolant pump and/or the control valve of the cooling system is open or closed loop controlled in the case that a fifth warming-up condition is fulfilled. The fifth warming-up condition can correspond or coincide with the third warming-up condition explained in the following.

The fifth warming-up condition in an embodiment is fulfilled when or provided that at least one or the coolant temperature exceeds a predetermined limit value, such as the third limit value explained in the following or at least one kinematic or kinetic parameter of the internal combustion engine or of the motor vehicle with the internal combustion engine exceeds a predetermined parameter limit value, such as a torque of the internal combustion engine exceeds a torque limit value, a rotational speed of the internal combustion engine exceeds a rotational speed limit value or a driving speed of the motor vehicle exceeds a driving speed limit value.

In an embodiment, the coolant pump is operated for a predetermined period of time following a starting of the internal combustion engine, then the cooling system is switched into a warming-up operating mode, in which the coolant pump is not operated, when a warming-up condition is fulfilled. In an embodiment, the cooling system accordingly includes a controller or other means for operating the coolant pump for a predetermined period of time following a starting of the internal combustion engine, and a switch, controller or other means for subsequently switching the cooling system into a warming-up operating mode, in which the coolant pump is not operated, when a warming-up condition is fulfilled.

Coolant, in an embodiment, can be advantageously distributed and/or circulated by way of the initial operating of the coolant pump for a period of time that is predetermined fixed or variably, such as a function of a temperature, in particular of an ambient, coolant, internal combustion engine and/or motor vehicle temperature, and a more homogeneous temperature distribution thereby be achieved.

By way of the subsequently switching into the warming-up operating mode, in which the coolant pump is not operated, as a function of the warming-up condition, the coolant pump in an embodiment is advantageously shut down or deactivated, in order to achieve a more rapid warming-up of the internal combustion engine and/or of the coolant by way of the internal combustion engine.

This warming-up operating mode is also described without restriction of the generality as an in particular the first warming-up operating mode mentioned above, this warming-up condition accordingly as the first warming-up condition.

In an embodiment, the bypass and/or the radiator line becomes or is closed in the first warming-up operating mode, at least substantially completely, by the control valve, which for this purpose becomes or is suitably controlled. Accordingly, in an embodiment, the cooling system includes a valve, actuator, controller or other means for closing the bypass and/or radiator line and/or the control valve in the first warming-up operating mode. Because of this, the coolant can be advantageously heated up even more rapidly in an embodiment.

The first warming-up condition in an embodiment is fulfilled when or provided that the coolant temperature undershoots a predetermined first limit value. In other words, the coolant pump, in an embodiment, is only shut down after expiration of the predetermined period of time when it is detected that the coolant temperature undershoots a predetermined first limit value.

In an embodiment, the method includes switching the cooling system into a closed loop control operating mode, in which the coolant pump and/or a or the control valve of the cooling system is open or closed loop controlled, instead of the first warming-up operating mode or following the initial operating of the coolant pump for a predetermined period of time following a starting of the internal combustion engine, in the case that the warming-up condition is not fulfilled. Accordingly, the cooling system in an embodiment includes a switch, controller or other means for switching the cooling system into a closed loop control operating mode, in which the coolant pump and/or a or the control valve or the cooling system is open or closed loop controlled, instead of the first warming-up operating mode, in the case that the warming-up condition is not fulfilled.

By way of this it is possible to advantageously change or switch into the closed loop control operating mode in an embodiment directly without prior shutting down of the coolant pump in the case that or provided that the first warming-up condition on or after expiration of the predetermined period of time is not fulfilled.

In the closed loop control operating mode, the coolant pump, in an embodiment, is open-loop controlled and the control valve pilot closed loop controlled, in each case based on a predetermined requested or set temperature, in particular coolant temperature. In another embodiment, the control valve is open-loop controlled and the coolant pump pilot closed loop controlled in the closed loop control operating mode in each case based on a predetermined requested or set temperature, in particular coolant temperature. Because of this, an undesirable feedback or mutual influencing can be advantageously reduced or prevented. Equally, both coolant pump and also control valve can, in the closed loop control operating mode, each become or be open or closed loop controlled, in particular pilot closed loop controlled.

In an embodiment, the method includes switching the cooling system from the first warming-up operating mode into the closed loop control operating mode or a or the second warming-up operating mode, in which the coolant pump is operated pulsed or with a predetermined rotational speed, in the case that a second warming-up condition is fulfilled. Accordingly, the cooling system, in an embodiment, includes a switch, controller or other means for switching the cooling system from the first warming-up operating mode into the closed loop control operating mode or the second warming-up operating mode, in which the coolant pump is operated pulsed or with a predetermined rotational speed in the case that a second warming-up condition is fulfilled.

As explained above, the switching from the first into the second warming-up operating mode also take place as a consequence of detecting a heater request and an exceeding of a fifth temperature limit value.

The predetermined rotational speed in an embodiment is a maximum of 10% greater than a minimum rotational speed of the coolant pump due to in particular design, flow and/or drive. In other words, the coolant pump, in an embodiment, is operated in the second warming-operating mode approximately with its minimum rotational speed. Because of this, the already heated coolant, in an embodiment, can be advantageously distributed or circulated.

Through a pulsed or periodic operating of the coolant pump, such advantageous circulation, in an embodiment, can also be realized also with coolant pumps the minimum rotational speed of which is too high. In addition or alternatively, the pulsed operating in an embodiment can bring about a circulation that is advantageous with respect to flow and/or heating.

In an embodiment, a pulse width of the pulsed operating is predetermined as a function of a kinematic or kinetic parameter of the internal combustion engine, such as a torque and/or a rotational speed, a temperature, in particular the coolant temperature, and/or a flow parameter of the internal combustion engine, in particular an air and/or fuel mass or volumetric flow rate. Accordingly, the cooling system, in an embodiment, includes a sensor, controller or other means for predetermining a pulse width of the pulsed operating as a function of a kinematic or kinetic parameter of the internal combustion engine, in particular a torque and/or a rotational speed, a temperature, in particular the coolant temperature, and/or a flow parameter of the internal combustion engine, in particular an air and/or fuel mass or volumetric flow rate. For example, with greater torque, greater rotational speed, higher coolant temperature, greater air and/or fuel mass or volumetric flow rate, a greater pulse width can be predetermined in order to thereby deliver more coolant.

In an embodiment, the control valve becomes or is open-loop controlled into a predetermined position in the second warming-up operating mode, such that the bypass and/or the radiator line is at least substantially completely closed. Accordingly, the cooling system in an embodiment includes an actuator, controller or other means for controlling the control valve into a predetermined position, such as for closing the control valve, in the second warming-up operating mode. By way of an at least substantially completely closed control valve, the coolant, in an embodiment, can be advantageously heated up more rapidly, by way of a partly opened control valve or an at least partly opened bypass line, the oil-coolant heat exchanger advantageously be utilized or operated even in the second warming-up operating mode.

The second warming-up operating mode is fulfilled in an embodiment when or provided that at least one or the reference means temperature exceeds a predetermined second limit value or at least one kinematic or kinetic parameter of the internal combustion engine or of the motor vehicle with the internal combustion engine exceeds a predetermined parameter limit value, in particular a torque of the internal combustion engine exceeds the torque limit value, a rotational speed of the internal combustion engine exceeds the rotational speed limit value or a driving speed of the motor vehicle exceeds the driving speed limit value. In other words, the coolant pump in an embodiment is again operated starting out from the first warming-up operating mode when it is detected that the reference temperature exceeds a predetermined second limit value or a kinematic or kinetic parameter of the internal combustion engine or of the motor vehicle exceeds a predetermined parameter limit value.

In an embodiment, a certain minimum cooling can thereby be ensured by the coolant circulated by the coolant pump when an critical reference, in particular material or component temperature or a kinematic or kinetic parameter of the internal combustion engine or of the motor vehicle so require.

In an embodiment, the method includes switching the cooling system from the second warming-up operating mode into the closed loop control operating mode in the case that a third warming-up condition is fulfilled. Additionally or alternatively, the method, in an embodiment, includes switching the cooling system from the second warming-up operating mode into the first warming-up operating mode in the case that a fourth warming-up condition is fulfilled. Accordingly, the cooling system, in an embodiment, includes a switch, controller or other means for switching the cooling system from the second warming-up operating mode into the closed loop control operating mode in the case that a third warming-up condition is fulfilled, and/or a switch, controller or other means for switching the cooling system from the second warming-up operating mode into the first warming-up operating mode in the case that a fourth warming-up condition is fulfilled.

As already explained above, switching from the first warming-up operating mode directly into the closed loop control operating mode is possible in an embodiment in the case that a second warming-up condition is fulfilled or instead in another embodiment, switching from the first warming-up operating mode initially into the second warming-up operating mode can be carried out in the case that the second warming-up condition is fulfilled. In this embodiment, switching from the second warming-up operating mode into the closed loop control operating mode can then be advantageously performed in the case that the third warming-up condition is fulfilled.

The third warming-up condition is fulfilled in an embodiment when or provided that at least one or the coolant temperature exceeds a predetermined third limit value or at least kinematic or kinetic parameter of the internal combustion engine or of the motor vehicle with the internal combustion engine exceeds a predetermined parameter limit value, in particular a torque of the internal combustion engine exceeds the torque limit value, a rotational speed of the internal combustion engine exceeds the rotational speed limit value or a driving speed of the motor vehicle exceeds the driving speed limit value. In other words, starting out from the second warming-up operating mode, switching in an embodiment into the closed loop control operating mode is carried out when it is detected that the coolant temperature exceeds a predetermined third limit value or a kinematic or kinetic parameter of the internal combustion engine or of the motor vehicle exceeds a predetermined parameter limit value. As mentioned above, this can correspond in particular to the fifth warming-up condition.

The predetermined third limit value, in an embodiment, is smaller by a predetermined deduction than the requested or set temperature. Because of this, it is possible in an embodiment to change with an offset into the closed loop control operating mode so that the regulation of the coolant pump and/or of the control valve advantageously responds more rapidly. Additionally or alternatively a loading of the cooling system and/or of the internal combustion engine through peak deflections can thus be advantageously reduced as a consequence of a pulsed operation of the coolant pump.

The fourth warming-up condition, in an embodiment, is fulfilled when or provided that the coolant temperature undershoots a predetermined fourth limit value. In other words, starting out from the second warming-up operating mode, switching back or over again into the first warming-up operating mode is carried out when it is determined that the coolant temperature undershoots a predetermined fourth limit value. The fourth limit value can in particular correspond to the seventh limit value mentioned above.

By switching back in this way into the first warming-up operating mode, in which the coolant pump is no longer operated, the operation of the cooling system can be advantageously improved, in particular a warming-up of the coolant optimized.

In an embodiment, the method includes checking an operational state of the control valve, in particular before an initial operating of the coolant pump or before the coolant pump is operated for a predetermined period of time following a starting of the internal combustion engine. If the check shows that the control valve does not function or operate properly, a message can be output in an embodiment and/or an operation of the internal combustion engine restricted, in particular prevented. Accordingly, the cooling system in an embodiment includes a sensor, controller or other means for checking an operational state of the control valve before the initial operating of the coolant pump following the starting of the internal combustion engine, and in a further development, a display, indicating device, controller or other means for outputting a message and/or for restricting or preventing an operation of the internal combustion engine in the case that the check shows that the control valve does not function or operate properly. Checking the control valve can include moving the control valve into one or more positions and comparing in each case the currently reached position with the predetermined or target position, in particular an at least substantially completely opened and/or an at least substantially completely closed position.

In an embodiment, the method includes operating the coolant pump for a predetermined period of time following a shutting-down of the internal combustion engine. This period of time and/or an operation or rotational speed of the coolant pump, can be or become predetermined in an embodiment in a fixed or variable manner, as a function of a temperature, in particular an ambient, coolant, internal combustion engine and/or motor vehicle temperature. Accordingly, the cooling system in an embodiment includes a switch, controller or other means for operating the coolant pump for a predetermined period of time following a shutting down of the internal combustion engine, and in a further development a sensor, controller or other means for predetermining the period of time and/or the operation, in particular a rotational speed of the coolant pump as a function of a temperature, in particular an ambient, coolant, internal combustion engine and/or motor vehicle temperature.

By way of such a post-running of the coolant pump that is temperature-dependent in particular in terms of time and/or rotational speed, a thermal loading of the internal combustion engine and/or of the motor vehicle can be advantageously reduced in an embodiment.

In an embodiment, switching into the closed loop control operating mode always takes place when at least one kinematic or kinetic parameter of the internal combustion engine or of the motor vehicle with the internal combustion engine exceeds a predetermined parameter limit value, in particular a torque of the internal combustion engine exceeds the torque limit value, a rotational speed of the internal combustion engine exceeds the rotational speed limit value or a driving speed of the motor vehicle exceeds the driving speed limit value.

A means in terms of the present disclosure can be designed as hardware and/or software, in particular include a digital processing with a microprocessor unit (CPU) that is data or signal-connected to a storage and/or bus system and/or include one or more program modules. The CPU can be designed in order to execute commands which are implemented as a program stored in a storage system, to detect input signals from a data bus and/or output output signals to a data bus. A storage system can include one or more in particular different storage media, in particular optical, magnetic, solid and/or other non-volatile or non-transitory media. The program can be of such a type that it embodies or is capable of carrying out the methods described here, so that the CPU can carry out the methods and thereby operate a cooling system. In an embodiment, one or more steps of the method are carried out in a completely or partly automated manner.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
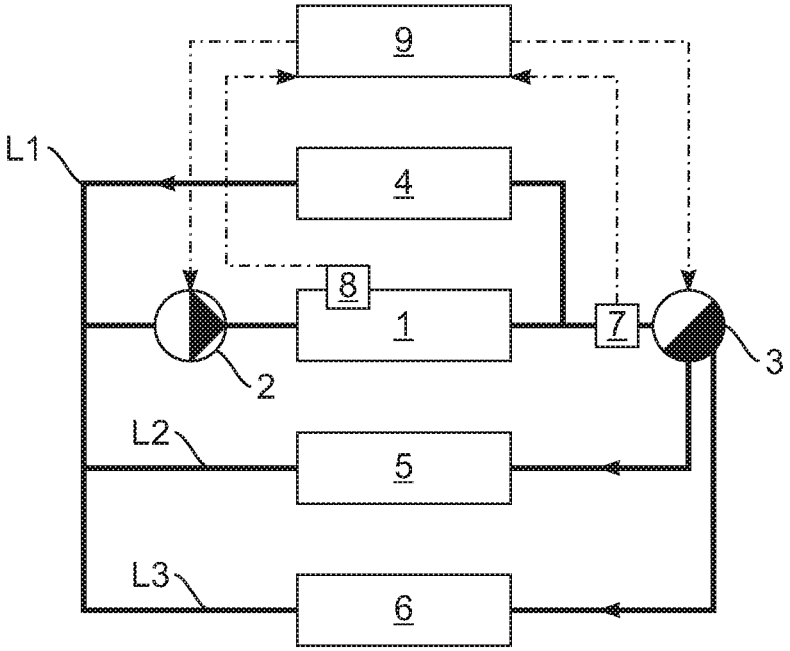
FIG. 1 shows a cooling system and an internal combustion engine of a motor vehicle according to an embodiment of the present disclosure.

FIG. 1 shows an internal combustion engine 1 and a cooling system of a motor vehicle which is not otherwise shown according to an embodiment of the present disclosure. The cooling system includes an electric coolant pump 2, a rotary control valve 3, a heater line L1 that is independent of the rotary control valve 3 with a heater 4 for heating an interior of the motor vehicle through a coolant that is circulated or delivered by the coolant pump 2, a bypass line L2 that is parallel in terms of flow to the heater line L1 with a heat-coolant heat exchanger 5 and a radiator line L3 that is parallel in terms of flow to the bypass line L2 with a radiator 6.

By way of the rotary control valve 3, the radiator line L3 and beforehand the bypass line L2 can be variably opened and closed optionally or dependent on position. In other words, the bypass line L2 is always opened when the radiator line L3 becomes or is opened.

The cooling system includes a coolant temperature sensor 7 for detecting a coolant temperature T m, which is arranged between the heater line L1 and an outlet of the rotary control valve 3, in a modification in the rotary control valve 3 that is not shown.

Additionally, the cooling system includes a reference temperature sensor 8 for detecting a reference temperature in the form of a cylinder head temperature $T_{mat}$. The reference temperature $T_{mat}$ is a critical temperature of the internal combustion engine that is a maximum in operation.

The cooling system, furthermore, includes an ECU 9, which carries out a method explained in the following with reference to FIG. 2 for operating the cooling system according to an embodiment of the present disclosure or is equipped to do so in terms of hardware and software and is connected in particular with respect to signaling to the electric coolant pump 2, the rotary control valve 3, the coolant temperature sensor 7 and the reference temperature sensor 8 as is indicated in dashed-dotted lines in FIG. 1. The ECU 9 open or closed loop controls the coolant pump 2 and the rotary control valve 3 and receives the coolant temperature $T_{cool}$ and the cylinder head temperature $T_{mat}$ from the coolant temperature sensor 7 and the reference temperature sensor 8 respectively.

In a modification that is not shown, the reference or cylinder head temperature $T_{mat}$ is not measured but calculated by the ECU 9 based on a model. Accordingly, the reference temperature sensor 8 can be omitted in this modification.

The method carried out by the ECU 9 for operating the cooling system according to an embodiment of the present disclosure includes a first step S10, in which it is checked if the internal combustion engine was started. For as long as this is not the case (S10: "N"), the check is periodically repeated. If the internal combustion engine was started (S10: "Y"), the control valve 3 is checked in a step S20. If the test shows that the control valve 3 does not properly function or operate (S20: "N"), a message is output in a step S30 and/or an operation of the internal combustion engine 1 restricted, in particular prevented.

In the case that the ECU 9 determines that the control valve 3 functions properly (S20: "N"), it proceeds with step S20. In the same it operates the coolant pump 2 for a period of time x0 after the starting of the internal combustion engine 1 which is predetermined fixed or variably in particular as a function of a temperature, in particular of an ambient, coolant, internal combustion engine and/or motor vehicle temperature.

Following this, the ECU 9 checks in a following step S50 if a first warming-up condition is fulfilled by checking of the coolant temperature $T_{cool}$ detected by the coolant temperature sensor 7 undershoots a predetermined first limit value $T_{thld}$. If the ECU 9 in step S50 detects that the coolant temperature $T_{cool}$ undershoots the first limit value $T_{thld}$ ($T_{cool}<T_{thld}$=S50: "Y"), it proceeds with step S70, otherwise (S50: "N") with step S60.

In step S60, the ECU 9 carries out a closed loop control operating mode in which the coolant pump 2 is open loop controlled and the rotary control valve 3 pilot closed loop controlled, in particular, in each case based on a predetermined requested or set coolant temperature $T_{request}$. If by contrast the first warming-up condition is fulfilled (S50: "Y"), the ECU 9 in step S70 switches over into a first warming-up operating mode. In the same, the coolant pump 2 is not operated. The bypass and the radiator line L2, L3 are completely closed in the first warming-up operating mode by the control valve 3 that is suitably controlled for this purpose by the ECU 9.

Following this, the ECU 9 in a subsequent step S80 checks if a second warming-up condition is fulfilled in that it checks if the reference or cylinder head temperature $T_{mat}$ exceeds a predetermined second limit value $T_{thld1}$, or a torque M of the internal combustion engine 1 exceeds a torque limit value $M_{thld}$ or a rotational speed n of the internal combustion engine 1 exceeds a rotational speed limit value $n_{thld}$ or a driving speed v of the motor vehicle exceeds a driving speed limit value $v_{thld}$. Here, even exceeding one of these limit values is sufficient in order for the second warming-up condition to be fulfilled ($T_{mat}>T_{thld}$ OR $M>M_{thld}$ OR $n>n_{thld}$id OR $v>v_{thld}$). If the ECU 9 in step S80 detects that the second warming-up condition is fulfilled or a heater request was detected and the reference temperature $T_{mat}$ exceeds a predetermined fifth limit value $T_{thld3}$ (S80: "Y"), it proceeds with step S90, otherwise (S80: "N") it returns to step S70 and continues to carry out the first warming-up operating mode.

In step S90, the ECU 9 carries out a second warming-up operating mode in which the coolant pump 2 is operated pulsed. In the second warming-up operating mode, the control valve 3 is open-loop controlled into a predetermined position in which in an exemplary embodiment it closes the bypass and the radiator line L2, L3, in another exemplary embodiment opens only the bypass line L2 and closes the radiator line L3.

The ECU 9 can predetermined a pulse width of the pulsed operating in step S90 as a function of a torque and/or a rotational speed of the internal combustion engine, the coolant temperature $T_{cool}$ and/or an air and/or fuel mass or volumetric flow rate. Following this, the ECU 9 in a subsequently step S100 checks if a third warming-up condition is fulfilled in that it checks if the coolant temperature $T_{cool}$ exceeds a predetermined third limit value $T_{request}-T_{thld6}$ or the torque M exceeds the torque limit value $M_{thld}$ or the rotational speed n exceeds the rotational speed limit value $n_{thld}$ or the driving speed v exceeds the driving speed limit value $v_{thld}$. Here, exceeding one of these limit values is again sufficient in order for the fourth warming-up condition to be fulfilled ($T_{cool}>T_{request}-T_{thld6}$ OR $M>M_{thld}$ OR $n>n_{thld}$ OR $v>_{thld}$). If the ECU 9 in step S100 detects that the third warming-up condition is fulfilled (S100: "Y"), it proceeds with S60, i.e. it switches over into the closed loop control operating mode, otherwise (S100: "N") it proceeds with step S110. As indicated by $T_{request}-T_{thld6}$, the third limit value is smaller by a predetermined deduction $T_{thld6}$ than the requested set coolant temperature $T_{request}$.

In step S110, the ECU 9 checks if a heater request is present or was detected, the coolant temperature $T_{cool}$ exceeds a predetermined sixth limit value $T_{thld5}$ and since the detection of the heater request and of the exceeded sixth limit value, at least a predetermined period of time x1 has expired. If this is the case (S110: "Y"), the ECU 9 in a step S150 switches over into a heater operating mode, otherwise (S110: "N") it proceeds with step S120.

In the heater operating mode or step S150, the coolant pump 2 is continuously operated with a constant rotational speed that is predetermined dependent on a heater request. The rotational speed that is predetermined dependent on a heater request is stored for example in a characteristic map and rises with an in particular percentage heater request in particular linearly and/or in discrete jumps. In the heater operating mode or step S150 the radiator line L3 is or becomes closed. The bypass line L2 is or becomes closed or opened in particular as a function of the coolant and/or an oil temperature.

In a step S160 following step S150, the ECU 9 checks if the coolant temperature $T_{cool}$ undershoots a predetermined seventh limit value $T_{thld5}-T_{Hyst}$, which, as indicated by "$-T_{Hyst}$", is smaller by a hysteresis deduction $T_{Hyst}$ than the sixth limit value $T_{thld5}$. If this is the case (S160: "Y"), the ECU 9 switches over into the first warming-up operating mode by returning to step S70. Otherwise (S160: "N") it proceeds with step S170. In the same it checks if a fifth warming-up condition is fulfilled in that as in step S100 it checks if the coolant temperature $T_{cool}$ exceeds the predetermined third limit value $T_{request}-T_{thld6}$ or the torque M exceeds the torque limit value $M_{thld}$ or the rotational speed n exceeds the rotational speed limit value $n_{thld}$ or the driving speed v exceeds the driving speed limit value $v_{thld}$. Here, exceeding one of these limit values is again already sufficient for the fifth warming-up condition to be fulfilled ($T_{cool}>T_{request}-T_{thld6}$ OR $M>M_{thld}$ OR $n>n_{thld}$ OR $v>v_{thld}$).

If the fifth warming-up condition is fulfilled (S170: "Y"), the ECU 9 switches over into the closed loop control operating mode by proceeding with step S60. Otherwise (S170: "N") it returns to step S150 and continues to carry out the heater operating mode.

In step S120, the ECU 9 checks if a fourth warming-up condition is fulfilled by checking if the coolant temperature $T_{cool}$ undershoots a predetermined fourth limit value $T_{thld5}-T_{Hyst}$. As is evident from the designation, the same corresponds to the seventh limit value. If the ECU 9 in step S120 detects that the fourth warming-up condition is fulfilled (S120: "Y"), it returns to step S70 and again carries out the first warming-up operating mode, otherwise (S120: "N") it returns to step S90 and continues to carry out the second warming-up operating mode.

In a step S130 following step S60, the ECU checks if the internal combustion engine 1 continues to run or becomes or is fired. For as long as this is the case (S130: "Y"), it remains in the closed loop control operating mode. If by contrast the ECU 9 in step S130 determines that the internal combustion engine 1 no longer runs or has (been) switched off (S130: "N"), it proceeds with step S140 in which it operates the coolant pump 2 for a predetermined period of time following the shutting down of the internal combustion engine 1. This period of time and/or the rotational speed of the coolant pump 2 can be or become predetermined in an embodiment in a fixed or variable manner, in particular as a function of a temperature, in particular of an ambient, coolant, internal combustion engine and/or motor vehicle temperature.

Following this, i.e. after expiration of this predetermined period of time, the ECU 9 or the method returns to step S10.

Figure 2:
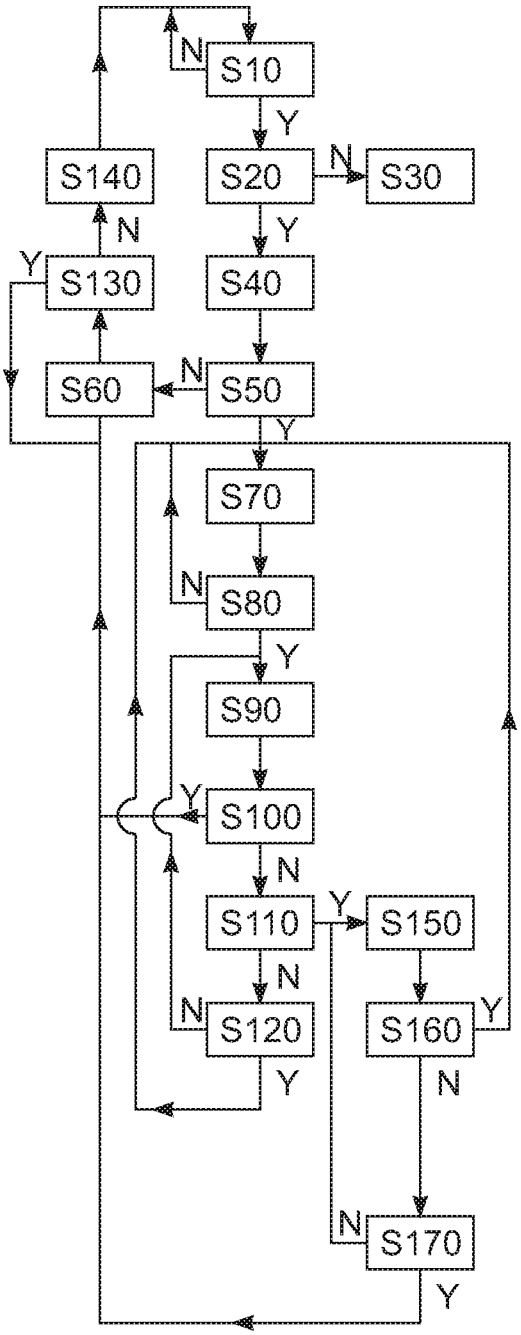
FIG. 2 is a flow chart showing a method for operating the cooling system according to an embodiment of the present disclosure.

It is evident that on exceeding the torque, rotational speed or driving speed limit value it is possible in a manner of speaking to "switch through" by the second warming-up operating mode and switch directly into the closed loop control operating mode when in FIG. 2 the steps S80 and S100 are answered in the affirmative ("Y").

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for operating a cooling system of an engine of a vehicle, with a heater for the vehicle and a coolant pump for the engine, the method comprising:

starting the engine;

operating the engine for a time period immediately following the start of the engine;

operating, during the time period, the cooling system in a first mode where the coolant pump circulates coolant through the cooling system and is on;

reading, after the time period, a temperature sensor to determine a temperature;

evaluating, by a controller, whether a heater request is present;

switching the cooling system from the first mode into one of a number of predetermined operating modes as a function of the heater request and the temperature, wherein the predetermined operating modes comprise a first warming-up operating mode, a second warming-up operating mode, and a heater operating mode;

evaluating, by the controller, the temperature to determine whether a first warming-up condition is fulfilled in which the temperature is below a first limit value;

when the first warming-up condition is fulfilled, operating by the controller, the cooling system in the first warming-up operating mode in which the coolant pump is off and in which a radiator line containing a radiator and a bypass line that bypasses the radiator are both completely closed by a control valve;

when operating in the first warming-up operating mode, evaluating, by the controller, whether a second warming-up condition is fulfilled;

when the second warming-up condition is fulfilled, operating, by the controller, the coolant system in the second warming-up operating mode in which the coolant pump is operated pulsed, and the control valve closes the radiator line and opens the bypass line;

when operating in the second warming-up operating mode, evaluating, by the controller, whether a third warming-up condition is fulfilled in which a heater request is present; and when the third warming-up condition is fulfilled, operating, by the controller, the cooling system in the heater operating mode with the coolant pump continuously operated at a rotational sped that is constant, and where the control valve closes the radiator line and modulates the bypass line as a function of the temperature.

2. The method according to claim 1, wherein the temperature is a coolant temperature, and further comprising switching the cooling system from the second warming-up operating mode into the heater operating mode wherein the rotational speed is predetermined dependent on the heater request.

3. The method according to claim 2, further comprising controlling a valve in the heater operating mode based on the coolant temperature to direct flow through a radiator line of the cooling system in which a radiator is arranged and a bypass line of the cooling system in which an oil-coolant heat exchanger is arranged.

4. The method according to claim 2, further comprising switching the cooling system from the heater operating mode into the first warming-up operating mode based on the coolant temperature.

5. The method according to claim 2, further comprising:

evaluating, by the controller, whether a fourth warming-up condition is fulfilled where the coolant temperature exceeds a predetermined limit value; and switching the cooling system from the heater operating mode into a closed loop control operating mode in which at least one of the coolant pump and a control valve of the cooling system is controlled when the warming-up condition is fulfilled.

6. The method according to claim 1, further comprising switching, from the heater operating mode into a closed loop control operating mode in which the coolant pump is open loop controlled and the control valve is closed loop controlled.

7. The method according to claim 1, wherein in the second warming-up operating mode the coolant pump is operated pulsed as a function of an engine operating parameter.

8. The method according to claim 7, further comprising:

switching from the second warming-up operating mode into the closed loop control operating mode when the third warming-up condition is fulfilled; and switching from the second warming-up operating mode into the first warming-up operating mode when a fourth warming-up condition is fulfilled.

9. A cooling system for an internal combustion engine comprising:

a heater;

a cooling circuit having a pump in fluid communication with the heater and configured to circulate a fluid through the heater and the internal combustion engine; and a controller operably coupled to the coolant circuit and configured to:

operate the cooling system in one of a number of predetermined operating modes as a function of a heater request and a temperature, wherein the predetermined operating modes comprise a first warming-up operating mode, a second warming-up operating mode, and a heater operating mode;

evaluate the temperature to determine whether a first warming-up condition is fulfilled in which the temperature is below a first limit value:

when the first warming-u condition is fulfilled, overate the cooling system in the first warming-up operating mode in which the coolant pump is off and in which a radiator line containing a radiator and a bypass line that bypasses the radiator are both completely closed by a control valve;

when operating in the first warming-up operating mode, evaluate whether a second warming-up condition is fulfilled:

when the second warming-up condition is fulfilled, operate the coolant system in the second warming-up operating mode in which the coolant pump is operated pulsed, and the control valve closes the radiator line and opens the bypass line;

when operating in the second warming-up operating mode, evaluate whether a third warming-up condition is fulfilled in which a heater request is present; and when the third warming-u condition is fulfilled, operate the cooling system in the heater operating mode with the coolant pump continuously operated at a rotational speed that is constant, and where the control valve closes the radiator line and modulates the bypass line as a function of the temperature.

10. The cooling system according to claim 9, wherein in the second warming-u operating mode, the controller is further configured to operate the pump in a predetermined rotational speed mode when the temperature exceeds a second limit value.

11. The cooling system according to claim 9, wherein the temperature is a coolant temperature, and wherein in the second warming-up operating mode the pump is operated with a rotational speed that is predetermined dependent on the heater request.

12. A method for operating a cooling system of an engine of a vehicle with a heater for an interior of the vehicle, a coolant pump for circulating a coolant through the cooling system, a control valve for controlling a flow of the coolant, a radiator line containing a radiator and a bypass line bypassing the radiator and containing a heat exchanger, the method comprising:

operating, by a controller and following a start of the engine, the coolant pump for a time period;

reading, by the controller and after the time period, a coolant temperature sensor to determine a coolant temperature;

evaluating, by the controller, the coolant temperature to determine whether a first warming-up condition is fulfilled in which the coolant temperature is below a first limit value;

when the first warming-up condition is fulfilled, operating the cooling system in a first warming-up operating mode in which the coolant pump is off and the bypass and the radiator lines are completely closed by the control valve;

when operating in the first warming-up operating mode, evaluating by the controller, whether a second warming-up condition is fulfilled;

when the second warming-up condition is fulfilled, operating the coolant system in a second warming-up operating mode in which the coolant pump is operated pulsed, and the control valve opens the bypass line and closes the radiator line;

when operating in the second warming-up operating mode, evaluating by the controller, whether a third warming-up condition is fulfilled in which a heater request is present;

when the third warming-up condition is fulfilled, operating the cooling system in a heater operating mode with the coolant pump continuously operated at a rotational speed that is constant, and with the control valve closing the radiator line and modulating the bypass line as a function of the coolant temperature;

when operating in the heater operating mode, determining whether the coolant temperature is below a third limit value; and when the coolant temperature is below the third limit value, returning by the controller, the cooling system to the first warming-up operating mode.

13. The method according to claim 12, wherein operating in the heater operating mode comprises determining the rotational speed based on a heater request level wherein the rotational speed is increased when the heater request level is increased.

14. The method according to claim 12, comprising: when the first warming-up condition is not fulfilled, operating by the controller, the cooling system with the coolant pump in open loop control and the control valve in closed loop control, wherein the open loop control and the closed loop control are based on a predetermined requested or a set coolant temperature.

* * * * *